United States Patent [19]

Goldbecker

[11] Patent Number: 4,502,398

[45] Date of Patent: Mar. 5, 1985

[54] THROAT PLATE FOR A DOUBLE LOCKSTITCH AUTOMATIC SEWING ARRANGEMENT

[75] Inventor: Wilfried Goldbecker, Steinhagen, Fed. Rep. of Germany

[73] Assignee: Kochs Adler AG, Bielefeld, Fed. Rep. of Germany

[21] Appl. No.: 473,735

[22] Filed: Mar. 9, 1983

[30] Foreign Application Priority Data

Mar. 11, 1982 [DE] Fed. Rep. of Germany ..... 3208779

[51] Int. Cl.[3] ..... D05B 21/00; D05B 73/12

[52] U.S. Cl. ..... 112/121.12; 112/260

[58] Field of Search ..... 112/121.12, 181, 184, 112/260, 320

[56] References Cited

U.S. PATENT DOCUMENTS

| | | | |
|---|---|---|---|
| 944,740 | 12/1909 | Madison | 112/181 |
| 1,358,567 | 11/1920 | Moffatt et al. | 112/260 |
| 3,125,049 | 3/1964 | Redman | 112/184 |
| 3,313,259 | 4/1967 | Daniel et al. | 112/260 |
| 3,808,991 | 5/1974 | Schaefer, Jr. | 112/121.12 |
| 4,088,085 | 5/1978 | Hager | 112/121.12 |

FOREIGN PATENT DOCUMENTS

| | | | |
|---|---|---|---|
| 285751 | 7/1915 | Fed. Rep. of Germany | 112/260 |

*Primary Examiner*—Wm. Carter Reynolds
*Attorney, Agent, or Firm*—Max Fogiel

[57] ABSTRACT

A throat plate of an automatic sewing arrangement producing a double lockstitch and having a feeding device for generating a feed motion in any direction in a sewing plane as a relative movement between the needle and a workpiece. The throat plate is formed at the surface turned towards the workpiece with a closed needle aperture area, and is formed at the surface turned away from the workpiece with an opened needle aperture area profiled with a thread guiding edge affecting the hook thread leaving the double lockstitch hook. The thread guiding edge controls the position of the hook thread with respect to the needle so as to avoid a double interlocked stitch formation.

3 Claims, 9 Drawing Figures

Fig. 1
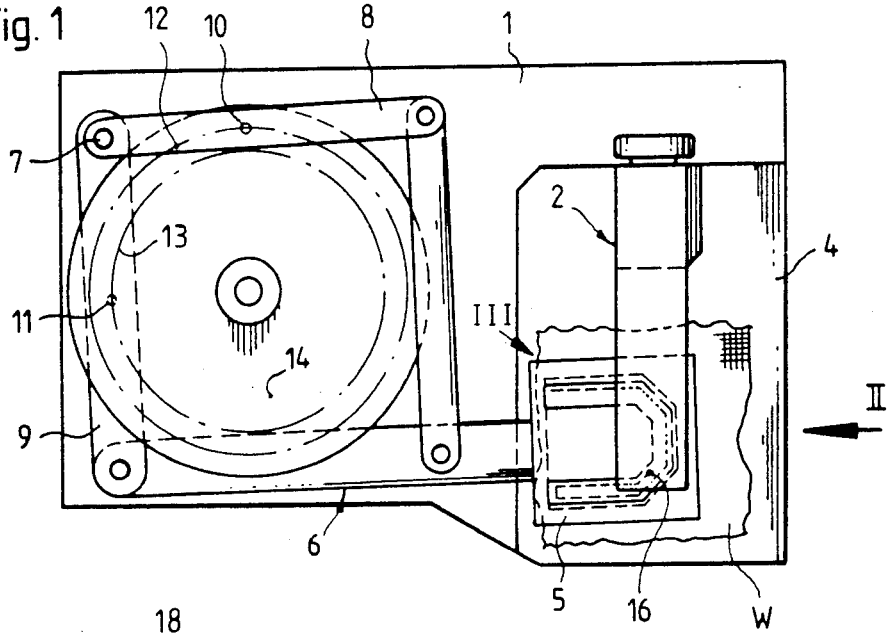
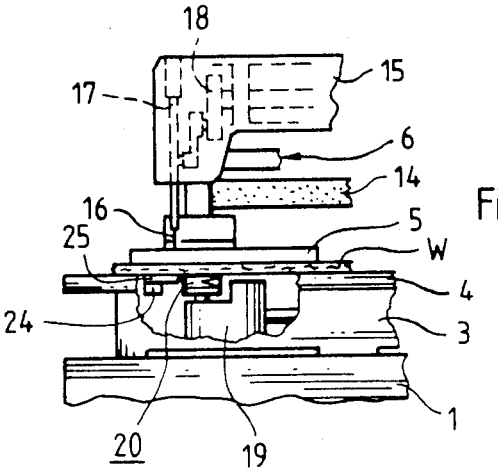
Fig. 2
Fig. 9
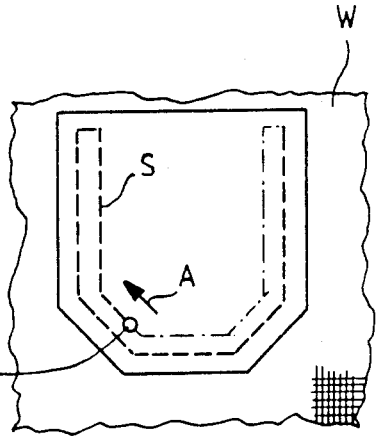

THROAT PLATE FOR A DOUBLE LOCKSTITCH AUTOMATIC SEWING ARRANGEMENT

BACKGROUND OF THE INVENTION

The present invention relates in general to an automatic sewing arrangement for producing a stitch contour in a workpiece according to a predetermined program. A movably arranged workpiece receiving device is controlled with respect to the needle by means of a linkage cooperating with a control cam where the workpiece may be fed by the workpiece receiving device in any direction relative to the needle. In particular, the automatic sewing arrangement is installed with a sewing head producing a double lockstitch row where a throat plate with a special aperture for the needle is applied for effecting the interlocking of the needle thread and the hook thread.

In U.S. Pat. No. 3,808,991 there is described an automatic sewing arrangement of a type in which the workpiece is moved with respect to the needle by a control. Due to the different feeding directions of the workpiece with respect to the needle, the stitch formation is effected. The needle thread and the hook thread are regularly interlocked to each other or the needle thread is additionally turned around the hook thread. Due to such abnormally formed stitches an optical different appearance of the produced stitch row is achieved which negatively affects the quality especially at the production of decorative stitches. Furthermore, it is necessary for the formation of firm stitches having such abnormal interlockings, to increase the thread tension for the needle thread, thus causing an increase in thread breakage.

Generally, it is known from the employment of such automatic sewing arrangements having a multi-directionally and continuously working workpiece feeding movement with respect to the needle to especially round the edges of the needle aperture so as to achieve a stitch formation with as little thread tension as possible.

In the aforementioned U.S. patent it is proposed to eliminate the formation of such abnormal stitches by displacing the total workpiece feeding mechanism with respect to the stationary stitch forming arrangement.

From the German Pat. No. 285 751 a throat plate for a double lockstitch sewing machine capable of sewing forward and backward stitches is known. The aperture for the needle is formed at the upper side with a slot and at the under side with a tubular guide edge so as to control the hook thread. Due to the special formation of the aperture, the support of the workpiece in the next neighborhood of a penetrating needle is not possible, so that the sewing of relative soft fabrics of a workpiece is associated with difficulties. Furthermore, the slot-shaped extension of the aperture is connected to additional edges thus rendering not possible a multi-directional workpiece movement.

Accordingly, it is the main object of the present invention to profile the aperture for the needle in such a way as to support the workpiece to be sewn as close as possible to the position of needle penetration and to effect the stitch formation for eliminating abnormal stitch formation.

Another object of the invention is to construct an aperture guiding the threads in the aforementioned kind without exposing the passing threads to additional stress.

It is a further object of the present invention to create a throat plate with the aforementioned properties which is simple in construction and inexpensive to manufacture.

Still a further object of the present invention is to provide a throat plate with an aperture effecting the stitch formation regardless of the direction of feed movement which is easy to install in automatic sewing arrangements that are already in use.

SUMMARY OF THE INVENTION

The objects of the present invention are achieved by providing the aperture for the needle at its under-side with an edge guiding the hook thread extending from an outlet at the double lockstitch hook to the under-side of the workpiece. The provision of a circular profile at the upper side of the aperture renders possible an equal support of the workpiece.

Other objects, advantages and features of the present invention will appear from the detailed description of the preferred embodiment which will now be explained in conjunction with the accompanying drawings.

BRIEF DESCRIPTION OF THE DRAWINGS

FIG. 1 shows a top plan view of an automatic sewing arrangement with a feeding device provided with a throat plate according to the present invention;

FIG. 2 is a partial side elevation of the automatic sewing arrangement seen in the direcion of the arrow II in FIG. 1, with the throat plate arranged in the base plate of the sewing arrangement;

FIG. 9 is an enlarged view of the workpiece illustrated in FIG. 1 when, however, turned around with respect to FIG. 1.

DESCRIPTION OF THE PREFERRED EMBODIMENT

Figure 3:
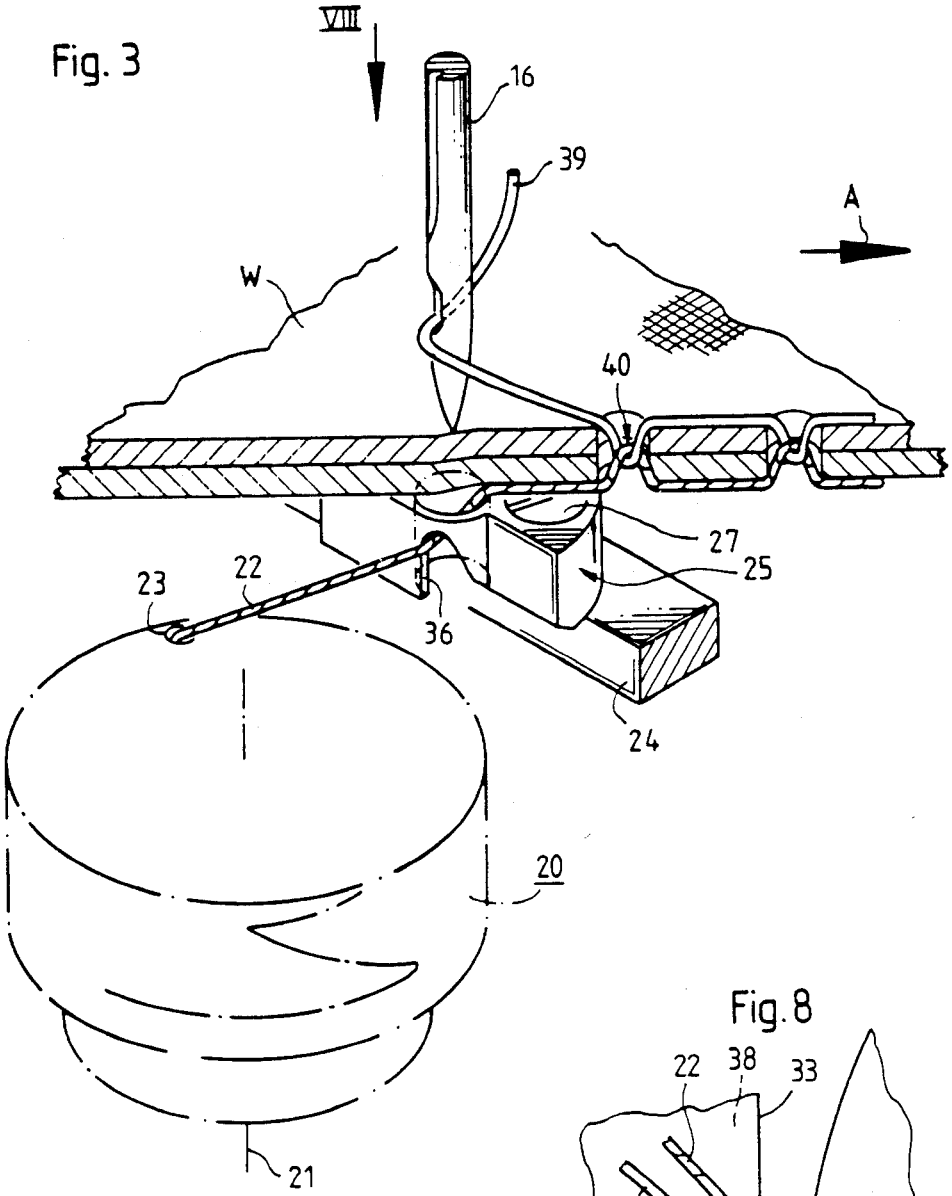
FIG. 3 is a diagrammatic perspective view of the throat plate according to the arrow III in FIG. 1.

FIG. 1 refers to an automatic sewing arrangement having a stand 1 for receiving a sewing machine 2 and its base plate 3. The base plate 3 is formed with a plate 4 for displaceably supporting a workpiece W, which is clamped by a workpiece clamp 5. The workpiece clamp 5 is drivingly connected to a parallelogram-shaped link system 6, which is pivoted at a stationary point of rotation 7 of the stand 1. The link system 6 is provided with two drive levers 8, 9 having guide rollers 10, 11. The latter cooperate with control grooves 12, 13 of a control disc 14, which is pivoted to the stand 1 and drivingly connected to the sewing machine 2 and a drive motor (not specified).

The sewing machine 2 is formed with an arm 15 for displaceably carrying a needle bar 17 with a needle 16. The needle bar 17 is drivingly connected to a crank gear 18. The base plate 3 of the sewing machine 2 is provided with a hook bearing 19, to which is pivoted a double lockstitch hook 20. According to FIGS. 3 to 4, the double lockstitch hook 20 has an axis 21, extending in parallel with the needle 16 is provided with a thread supply (not specified) delivering a hook thread 22 through an outlet 23. A throat plate 25 is formed with an upper surface 28 as a workpiece supporting area arranged in the plane of the plate 4 carrying the workpiece W. Furthermore, the throat plate 25 is formed with a lower surface 26 extending in parallel to the upper surface 28. With respect to the latter the lower surface 26 also may be considered as an opposite area. According to FIGS. 2 to 4 the base plate 3 is arranged with a carrier 24, to which is fastened the lower surface 26 of the throat plate 25 by means of screws 27. The throat plate 25 is provided with an aperture 29 about which extends concentrically an outer surface 30. About the aperture 29 there is drawn a quadrantally-shaped wall 31 forming a tubular portion 32 with the aperture 29. On one hand the tubular portion 32 terminates in a radial surface 33 extending in parallel with the aperture 29, and on the other hand in a surface 34 extending in parallel with the aperture 29 and tangentially joining with the tubular portion 32.

Figure 5:
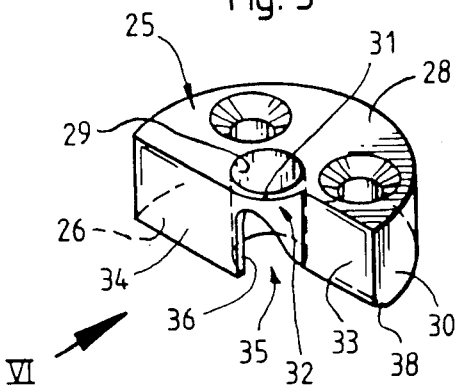
FIG. 5 is a perspective view of the throat plate according to the present invention.
Figure 6:
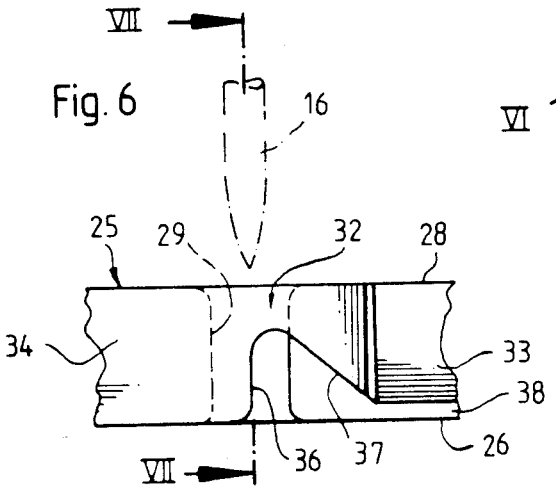
FIG. 6 is a view of the throat plate in the direction of the arrow VI in FIG. 5.

According to FIGS. 5 and 6, the aperture 29 is formed at its lower surface with an opened area 35, which terminates in a thread guiding edge 36 extending in parallel with the needle 16, and an angular edge 37. According to the view of FIG. 8, the thread guiding edge 36 is such as formed as deviating the hook thread 22 leaving the outlet 23 and entering into the aperture 29. The angular edge 37 terminates in a chamfer 38 formed at the lower surface 26 of the throat plate 25. The thread guiding edge and the angular edge are relatively arranged in an acute angular relationship. The thread guiding edge projects with respect to a line connecting the outlet for a hook thread with the needle.

Figure 4:
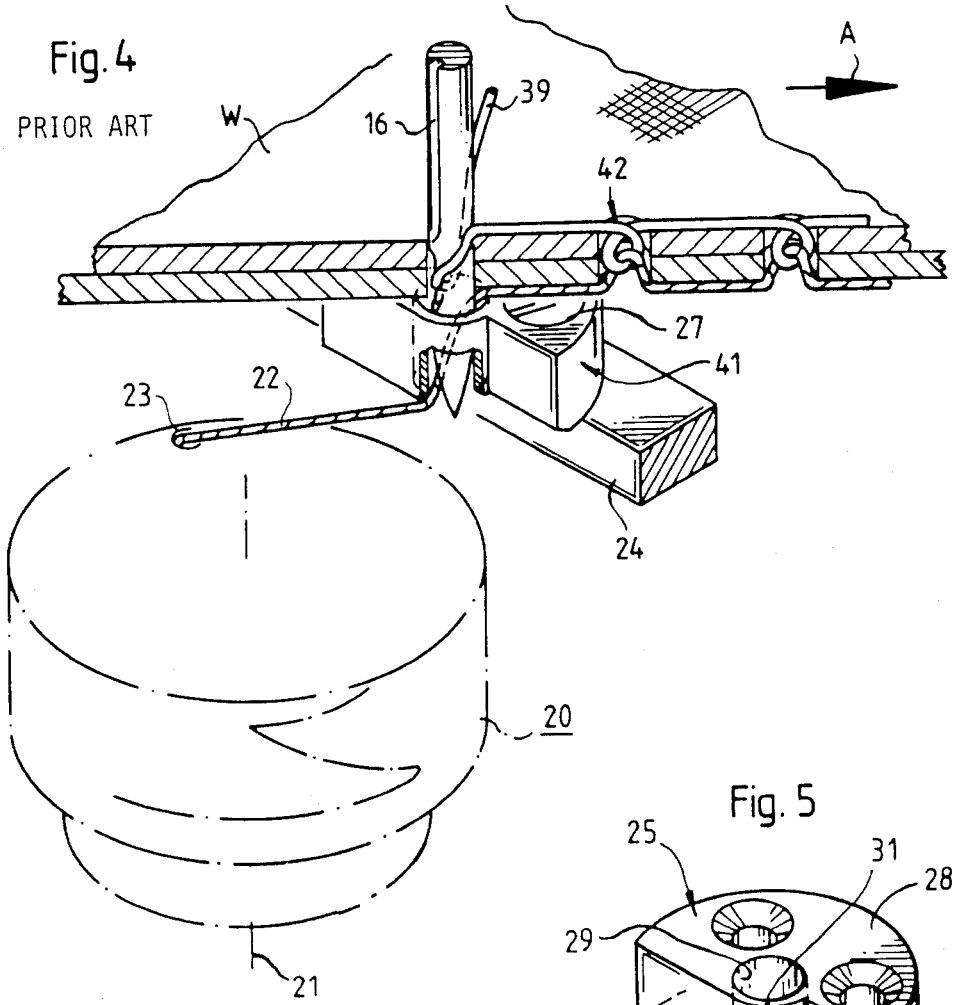
Fig. 4 PRIOR ART
FIG. 4 is a view according to FIG. 3, in which the throat plate, according to the present invention, is replaced by a throat plate known from the prior art.

The operation of the throat plate 25 may be described as follows:

As the drive motor drives the sewing machine 2 and the control disc 14, a workpiece W is advanced with respect to the reciprocating needle 16, according to the course of the control grooves 12, 13, by the link system 6. The direction of the arrow A in FIG. 3 corresponds to the movement of the workpiece W with respect to the stationary needle 16, which produces a fastening seam S in the workpiece W for attaching a pocket. The stitch formation as illustrated in FIGS. 3 or 4 is based on the movement of the workpiece W in the direction of the arrow A with respect to the needle 16.

Figure 8:
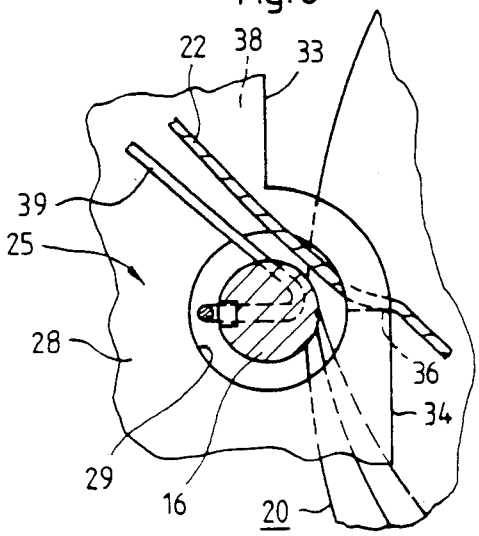
FIG. 8 is a top plan view of the throat plate in the direction of the arrow VIII in FIG. 3.
Figure 7:
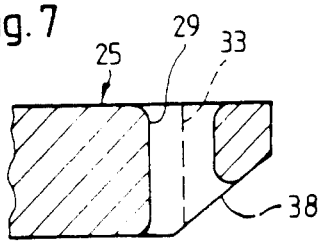
FIG. 7 is a sectional view of the throat plate taken along line VII—VII in FIG. 6.

The needle 16 carries a needle thread 39, which, during sewing, is brought through the workpiece W. With this action, the workpiece W rests on the upper surface 28 of the throat plate 25 as long as the needle 16 reaches its lowest position. As the needle 16 rises again, the needle thread 39 forms a loop, which is seized by the hook point of the hook 20 and wound around the latter. According to FIG. 3, the needle thread 39 extends, when entering the workpiece W, in front of the needle 16 around the latest interlock 40. The thread guiding edge 36 deflects the hook thread 22, leaving the outlet 23 of the hook 20 in such a manner, that the hook thread 22 coming from the thread guiding edge 36, extends upwardly inside of the aperture 29 to the last interlock 40. This special guidance of the hook thread 22 ensures that the hook thread 22 leaving the outlet 23 of the hook 20, is located on the same side of the needle 16 where the needle thread 39 surrounds the needle 16 (FIG. 8). Consequently, the formation of the single interlock 40 (FIG. 3) is guaranteed to a greatest extent. In opposition to FIG. 3, FIG. 4 shows a stitch forming operation, in which the needle thread 39 and the hook thread 22 are positioned on different sides of the needle 16. Due to the shape of the aperture of the throat plate 41 as known in the prior art, both, the needle thread 39 and the hook thread 22 are allowed to pass through the aperture in a position relative to the needle 16, as shown in FIG. 4. The throat plate 41 does not guidingly affect the hook thread 22 and acts in no manner against the formation of double interlocks 42 shown in FIG. 4.

The throat plate according to the present invention may also be employed in an automatic sewing machine installed with a double lockstitch hook rotating about a horizontal axis.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What is claimed is:

1. An automatic sewing arrangement for producing a double lockstitch contour in a workpiece, comprising:
a sewing machine having stitch forming means including:
a needle reciprocatingly operating on a linear path and carrying a needle thread;
a hook having an axis of rotation situated in parallel to said path and an outlet for a hook thread guided in a predetermined direction;
a workpiece supporting plate and a throat plate with an aperture cooperating with said needle, said throat plate comprising a workpiece supporting area of substantially circular geometry and an opposite area;
a workpiece receiving device; and
control means generating a feed movement as a relative motion between said needle and said workpiece according to a predetermined program;
said aperture further comprising
an opened area arranged at said opposite area including:
a thread guiding edge deviating said hook thread leaving said outlet and entering into said aperture and extending parallel to said path of said needle from said opposite area towards said workpiece supporting area;
an annular edge merging with said thread guiding edge in an acute angular position and terminating in a chamfer arranged at said opposite area; and
a tubular portion surrounding said aperture at which said angular edge is formed.

2. An automatic sewing arrangement for producing a double lockstitch contour in a workpiece, comprising:
a sewing machine having stitch forming means including:
a needle reciprocatingly moving on a linear path and carrying a needle thread;
a vertical axis hook having an outlet for a hook thread;
a workpiece supporting plate and a throat plate with an aperture cooperating with said needle, said throat plate comprising a workpiece supporting area of substantially circular geometry and an opposite area;

a workpiece receiving device; and control means generating a feed movement as a relative motion between said needle and said workpiece according to a predetermined program;

said aperture comprising:

an opened area arranged at said opposite area formed by a thread guiding edge extending from said opposite area towards said workpiece supporting area and terminating in an angular edge extending back to said opposite area, said angular edge being inclined to said opposite area.

3. An automatic sewing arrangement for producing a double lockstitch contour in a workpiece, comprising:

a sewing machine having stitch forming means including:

a needle reciprocatingly moving on a linear path and carrying a needle thread;

a vertical axis hook having an outlet for a hook thread guided in a predetermined direction;

a workpiece supporting plate and a throat plate with an aperture cooperating with said needle, said throat plate comprising a workpiece supporting area of substantially circular geometry and an opposite area;

a workpiece receiving device; and control means generating a feed movement as a relative motion between said needle and said workpiece according to a predetermined program;

said aperture further comprising:

an opened area arranged at said opposite area formed by a thread guiding edge extending parallel to said path of said needle from said opposite area towards said workpiece supporting area and terminating in an angular edge extending back to said opposite area, at which said angular edge is situated at a tubular portion of said aperture, said angular edge being inclined to said opposite area.

* * * * *